United States Patent [19]

Donini et al.

[11] 4,453,270

[45] Jun. 5, 1984

[54] PASTED VALVE STEPPED END BAG

[75] Inventors: Jack R. Donini; Jonathon Tomshack, both of Wellsburg, W. Va.

[73] Assignee: Westvaco Corporation, New York, N.Y.

[21] Appl. No.: 379,754

[22] Filed: May 19, 1982

[51] Int. Cl.[3] ..... B65D 30/26

[52] U.S. Cl. ..... 383/115; 383/98; 493/213; 493/929

[58] Field of Search ..... 229/62.5, 55, 57; 383/53, 54, 115, 125, 126, 114, 98; 493/213, 929, 933, 219, 235, 261

[56] References Cited

U.S. PATENT DOCUMENTS

| | | | |
|---|---|---|---|
| 1,960,929 | 5/1934 | Taggart | 383/115 |
| 2,176,499 | 10/1939 | Hoppe et al. | 229/55 |
| 2,176,996 | 10/1939 | Leonard et al. | 383/98 X |
| 2,177,122 | 10/1939 | Tooker | 229/62.5 |
| 2,359,190 | 9/1944 | Avery et al. | 383/115 X |
| 2,460,885 | 2/1949 | Hoppe | 493/213 X |
| 2,761,612 | 9/1956 | Grosset et al. | 229/62.5 |
| 2,764,339 | 9/1956 | Owens | 229/55 |
| 2,891,716 | 6/1959 | Lee | 229/62.5 |
| 2,906,446 | 9/1959 | Williams | 229/62.5 |
| 3,000,550 | 9/1961 | Charlton | 229/62.5 |
| 3,000,551 | 9/1961 | Atwood | 229/62.5 |
| 3,216,647 | 11/1965 | Arnold | 229/62.5 |
| 3,220,635 | 11/1965 | Rasting et al. | 383/126 |
| 3,306,522 | 2/1967 | Honsel | 229/55 |
| 3,397,622 | 8/1968 | Goodwin | 229/62.5 |
| 3,412,925 | 11/1968 | Booth et al. | 229/55 |
| 3,591,072 | 7/1971 | Sannino | 383/54 |
| 3,596,826 | 8/1971 | Reiselt | 229/55 |
| 3,785,547 | 1/1974 | De Vries | 383/53 X |
| 3,853,040 | 12/1974 | Achelpohl | 493/213 X |
| 4,095,736 | 6/1978 | Rothschild et al. | 229/62.5 |
| 4,264,317 | 4/1981 | Feldkämper | 493/213 |
| 4,266,469 | 5/1981 | Feldkämper | 493/219 |

FOREIGN PATENT DOCUMENTS

| | | | |
|---|---|---|---|
| 1120856 | 12/1961 | Fed. Rep. of Germany | 383/53 |

*Primary Examiner*—William Price
*Assistant Examiner*—Bryon Gehman

[57] ABSTRACT

The pasted valve, stepped end bag of the present invention is rendered substantially sift resistant as a result of, (1) the particular stepped end pattern chosen for the bag; (2) the placement of the valve sleeve at one end of the bag; and, (3) the arrangement of the infolded flaps at the opposite end of the bag. The particular step pattern chosen for the bag provides increased pasting area as compared with conventional PVSE bags and gives the bag greater strength while contributing to its sift resistant characteristics. Meanwhile, by placing the valve sleeve in the corner of the bag so that one end thereof extends underneath the opposite infolded flap, and by overlapping the inner edges of the infolded flaps at the opposite end of the bag, the channels where sifting normally occurs are blocked thus preventing products packaged in the bag from leaking.

16 Claims, 13 Drawing Figures

PASTED VALVE STEPPED END BAG

BACKGROUND OF INVENTION

The present invention is directed to improved end closures for pasted valve, stepped end bags and more particularly to improved end closures that render such bags substantially sift resistant.

All pasted valve, stepped end bags have three scored folds in each corner. Two of the scores are provided for folding the overlapping flaps that form the top and bottom closures of the bag. The third score is created by the edge folds at each side of the bag when the tubular bag structure is formed. These scores ultimately become the center scores in each infolded flap at each corner of the bag. Pasted valve, stepped end bags are highly prone to sifting through the channels formed by these scores. In addition, such bags are also prone to leakage in and around the valve area when a valve sleeve is improperly located or not completely closed.

Paper bags of the pasted valve, stepped end type (PVSE) are in common use for packaging bulk materials. Such bags are made from tough, strong paper or other fibrous material, and usually have walls comprising multi-ply layers to increase their strength. The bags are used for packaging many kinds of bulk materials such as cement, fertilizer, feed grain, flour and the like and are filled by inserting a filling nozzle through the valve (or valve sleeve where provided), and blowing the material therein. After filling, the nozzle is withdrawn and the valve is automatically closed by the weight of the material in the bag when the bag is turned upside down, or where valve sleeves are provided, the valve sleeve may be closed with a fold and tuck, or with a hot melt adhesive or the like.

Valve sleeves are usually made from a single sheet of paper or other material to form a tube and the tubular sleeve is adhesively secured to the valve flaps. In a PVSE bag, the sleeve is adhesively secured between the overlapping pasted outer flaps and one of the infolded panels at a corner of the bag. Various attempts have been made in the past to make such bags and valves leak resistant and to overcome the sifting problems occuring at both ends, however, none of the prior attempts have achieved the success of the present invention.

SUMMARY OF INVENTION

The present invention is directed to an improved construction for pasted valve, stepped end (PVSE) bags. The improved construction renders the bag substantially sift resistant, and thus useful for packaging products heretofore unsuitable for conventional PVSE bags. The bag construction of the present invention includes a novel placement of the valve sleeve at one end, and an overlapping scheme for one or more bag plies at the opposite end of the bag. Although valve location may be varied from one end of the bag to the other, for the purpose of this description, the valve end is referred to as the top of the bag and the opposite end is the bottom of the bag.

All PVSE bags are formed in a tubular shape from multiple plies of paper or other material. The bag tube lengths are ruptured from a continuous multi-ply bag tube that is formed on a tubing machine by the assembly of a plurality of webs for the plies. The plies are perforated transversely in the desired step patterns across their full width, prior to being glued together, to provide the stepped lines for the ends of the severed tubes.

Rupturing is accomplished by tensioning each leading bag tube length.

Each web is perforated so that the respective lengths of the bag plies are equal, both at the front and rear faces of each flattened tube. However, the webs are brought together and glued with the perforated lines of each web staggered with respect to the next succeeding ply to provide stepped ends of the desired type. In this manner the perforated lines which form the bottom end of the leading bag simultaneously form the top end of the next successive bag with no excised paper and no waste. The ends of the tubes are then scored to produce opposed infolded panels having a substantially diamond shape, and outer overlapping flaps that are extensions of the side walls of the bag. The bottom end of such a bag is formed by pasting the overlapping panels to one another and to the infolded panels. The top or valve end of such bag is formed at one side by pasting the overlapping panels to one another and to a first infolded panel at one side of the bag, while the infolded panel at the opposite side of the top is left unadhered to form a valve opening. When such prior art bags are provided with valve sleeves, the valve sleeves are formed as tubes and adhered to the infolded panel and overlapping panels in the valve area. Generally one end of the valve sleeve extends out the valve opening to the edge of the bag. Meanwhile, the inner edges of the infolded panels at both ends of such prior art bags are spaced apart a substantial distance so that the opposite end of the valve sleeve may terminate in a filling space between those inner edges.

In contrast to the above conventional construction of PVSE bags, the bag construction of the present invention is designed so that the infolded panels at the bottom of the bag overlap one another to create a substantially leak resistant closure, while the infolded panels at the top of the bag are only slightly spaced apart to provide a filling space or gap of minimum size. This construction is achieved as follows. In a preferred embodiment, the infolds in the bottom of the bag are arranged to overlap by cutting and stepping the plies in the tube. In a typical four ply bag construction the plies are cut and stepped so that one of the plies extends beyond the nominal end of the bag at each corner. In a preferred construction, the number two ply extends beyond the flap panel formed by the number one or inner ply. When the infolded panels are folded in, the number two ply extends from the edge of the tube by an amount beyond the center of the width of the tube sufficient to provide an overlap of at least about one-half inch in the bottom of the bag. The amount of overlap depends upon the step pattern used and the amount of material folded inwardly with the infolded panels. Overlapping of the number two ply blocks product from getting into the channels formed by the infolded panels and the edge scores on the bottom of the bag, and substantially prohibits sifting of the product in that area. In addition, a solid bar of paste is placed across the width of both infolded panels in the bottom of the bag between the number one and number two plies to prevent product from sifting between those plies. The longer infolds necessary to maintain an overlapped condition of the number two ply at the bottom of the bag provide larger than normal paste areas for closing the bottom of the bag. Meanwhile at the top of the bag, the stepped end pattern and length of the infolded panels is designed to produce, in the preferred embodiment, a construction with a minimum sized filling gap between the ends of the number one ply to form the valve end of the bag. When this valve is sleeved, the sleeve is preferably placed in one corner over the end folded panel with its outer end at or near the edge of the bag. The valve sleeve is arranged to extend inwardly beyond the filling gap with its inner end located underneath the opposite end folded panel. Paste is applied along the sides of the end folded panels, on the overlapping outer flaps and beneath the valve sleeve to close the top or valve end of the bag. This arrangement prevents product from sifting into the channels formed by the infolded panel scores and the edge score at the top of the bag. After filling, the sleeve can be closed by folding it over and tucking it under itself so that it does not extend beyond the edge of the filled bag. For very fine and powdery products, where a more positive closure of the sleeve is desired, the sleeve can be made with a heat sealable coating (e.g. low density polyethylene or surlyn), or it can be made with a heat sealable material laminated to a paper backing. Sleeves of this construction which extend outside of the valve can first be heat sealed closed and then folded and tucked in for a more sift resistant closure.

In at least one other embodiment for carrying out the present invention, the number two ply may be omitted and replaced with a pair of reinforcing strips located at each side edge of the bag tube. The reinforcing strips need not extend across the full width of the bag, but they may be oriented within the structure of the bag to give a greater overlap in the bottom of the bag or to make a wider bag. In connection with the first embodiment, there is a direct correlation between the face width of the tube and the valve size for the bag. That is, because of the geometry of the bag and because the bag is prepared from a plurality of plies having the same nominal length, the valve size correlates with the face width. However, where it is desired to manufacture a bag having a specific valve size, but a non-correlative face width, one or more of the bag plies may be omitted and replaced with the aforementioned structural strips. When structural strips are employed, the same folding and pasting sequence is used to close the ends of the bag, only a larger filling gap or space is created.

In other instances, both ends of the bag tube may be cut and stepped, and scored to produce infolded flaps that overlap one another. Sleeving a bag with an overlap at the filling gap is more difficult than sleeving a bag with an exposed filling gap, but such a construction is contemplated within the present invention.

Thus it will be seen from a review of the attached drawings and detailed description that the present invention provides a novel bag structure not heretofore disclosed by the prior art.

DETAILED DESCRIPTION

Figure 3:
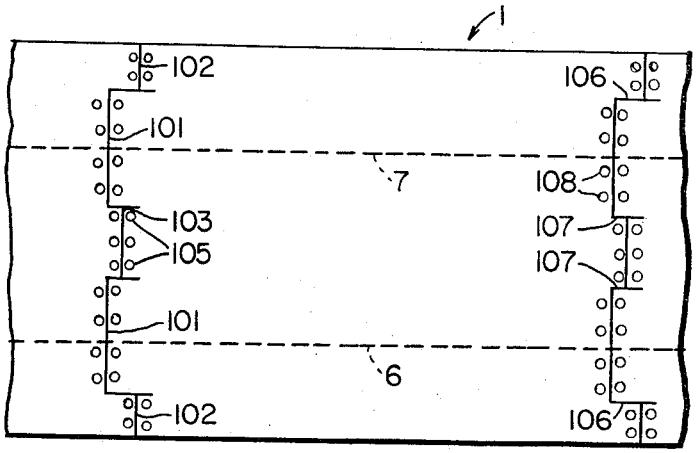
FIG. 3 is a plan view of a preformed bag ply showing a typical step pattern and adhesive application.
Figure 3A:
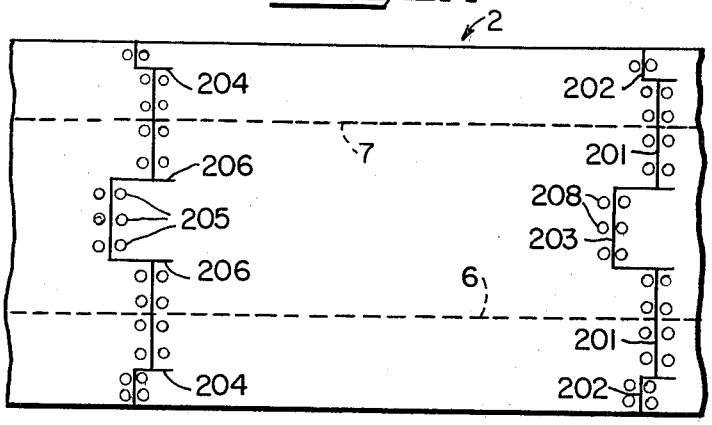
FIGS. 3A–3C are plan views showing other typical bag plies.
Figure 3B:
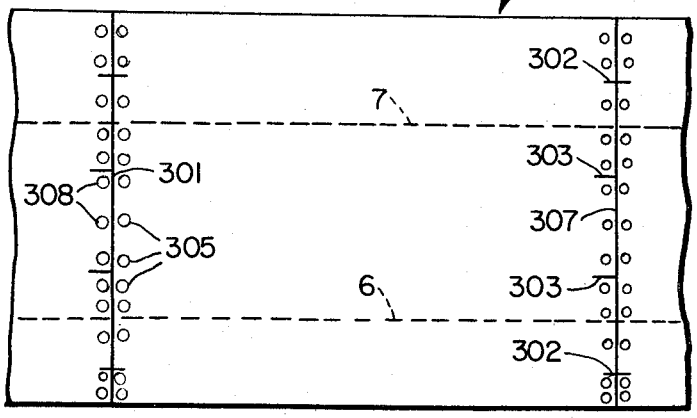
Figure 3C:
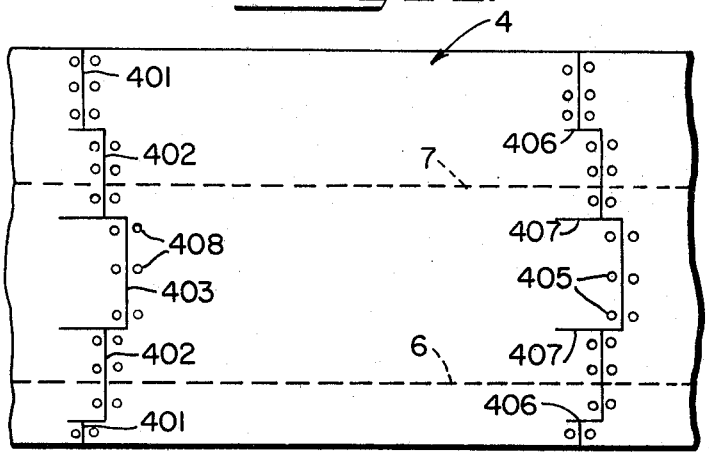
Figure 4:
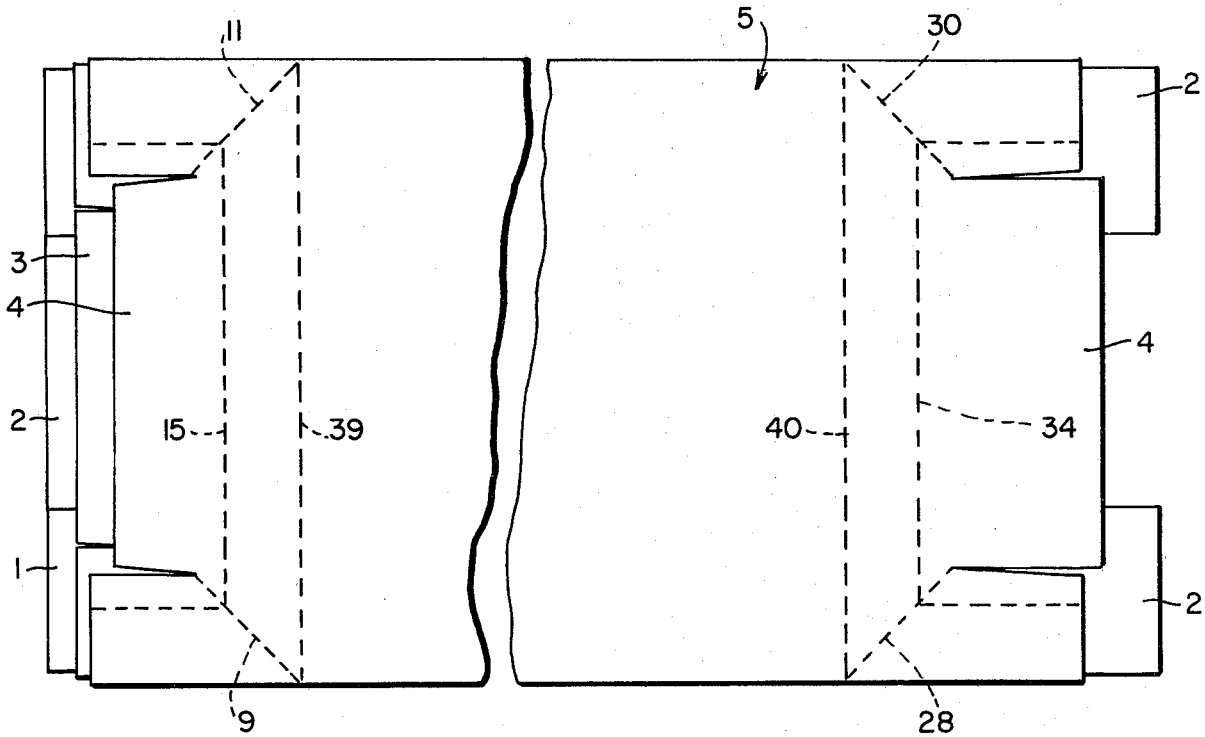
FIG. 4 is a plan view of a single glued and scored bag tube.

Referring to the drawings and particularly FIGS. 3 and 3A–3C, which show discrete bag plies having different end step patterns, the reference numerals 1 through 4 identify respectively the different plies of the bag from number one (inner ply) to number four (outer ply). The number one ply is divided into three parts by horizontal score lines 6,7 and includes stepped lines of perforation 101,102 and 103 which are placed transverse to the length of the web 1 at evenly spaced intervals. Portions of the perforations at 102 and 103 are offset to produce the stepped end construction. Each of these portions are joined by cut lines 106,107 and the ends of the bag ply are applied with paste spots 105,108 in a conventional manner. The number two ply shown in FIG. 3A includes slightly staggered scored lines 6,7 and stepped lines of perforations 201,202,203 joined by cut lines 204,206. In like manner, paste is applied at each end of the number two bag ply as shown at 205,208. FIG. 3B shows the number three bag ply with straight lines of perforation 301,307 at each end interrupted by the cut lines 302,303 and applied with paste at 305,308. Likewise, FIG. 3C shows the number four or outer ply of the bag with staggered fold lines 6,7 and stepped lines of perforations 401,402,403. These steps are joined by cut lines at 406, 407 and the ends of the number four bag ply are applied with paste at 405,408. The staggered fold lines 6,7 in each ply insure that all of the side seams will not be aligned when the bag is formed. FIG. 4 shows the formed bag tube 5 in flattened condition before the ends are squared for closing. Note in FIG. 4 that the various bag plies one, two, three, four are stepped with respect to one another at the left or top of the bag while the number two ply extends beyond the nominal end of the bag at the right or bottom of the bag. Meanwhile, the bag tube is applied with transverse scores at 39,40 about which the ends are folded to form the bottom and top closures.

Figure 5:
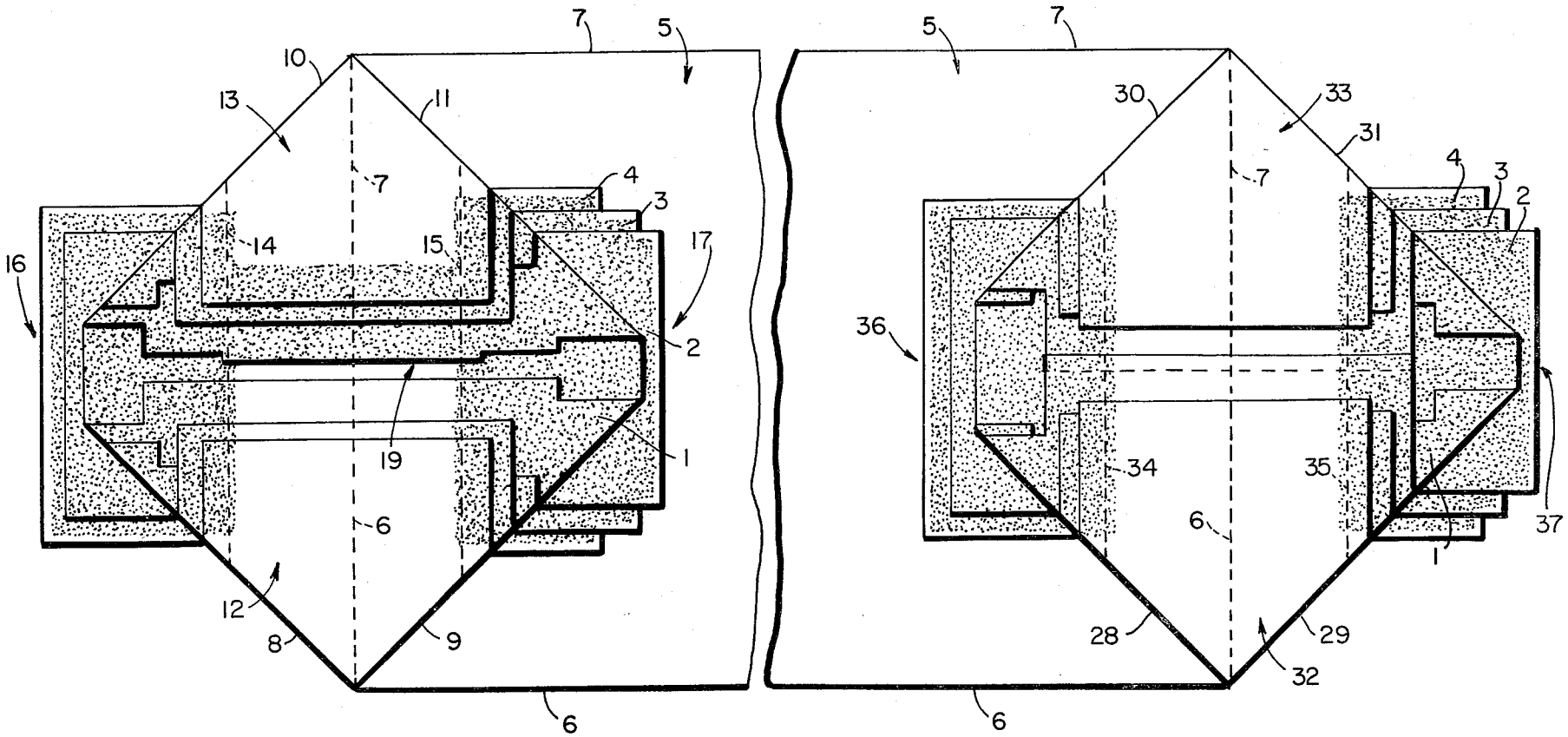
FIG. 5 is a plan view of the bag tube shown in FIG. 4 with the ends folded and adhesive applied.

As shown in more detail in FIG. 5, the bag tube 5 has side scores 6,7 and each corner is applied with diagonal scores 8,9 and 10,11 at the top to form the diamond shaped infolded panels 12,13, and diagonal scores 28,29 and 30,31 at the bottom to form the diamond shaped infolded panels 32,33. Transverse scores 14,15 are applied to the infolded panels at the top to form the overlapping flaps 16,17 and similar scores 34,35 are applied to the infolded panels at the bottom to form the overlapping flaps 36,37. Where the bag is applied with a valve sleeve, the sleeve 18 is positioned at one corner as shown in FIG. 6.

In general, conventional PVSE bags normally have a fairly large filling gap 19 at the top or valve end. In such bags, when sleeves are applied, the sleeves extend only to a point about midway of the filling gap. However, in the preferred embodiment of the present invention, the distinct step pattern for the ends of the bag and the scoring pattern at the top together serve to provide larger than normal end folded panels 12,13 and a fairly narrow filling gap or space 19 between the inner edges of the number one ply as shown in FIG. 5. The larger infolded panels provide greater than normal pasted areas, which inherently increase the strength and sift resistance of the bag, and the longer infolds provide an ideal configuration for locating a valve sleeve according to the present invention.

Figure 6:
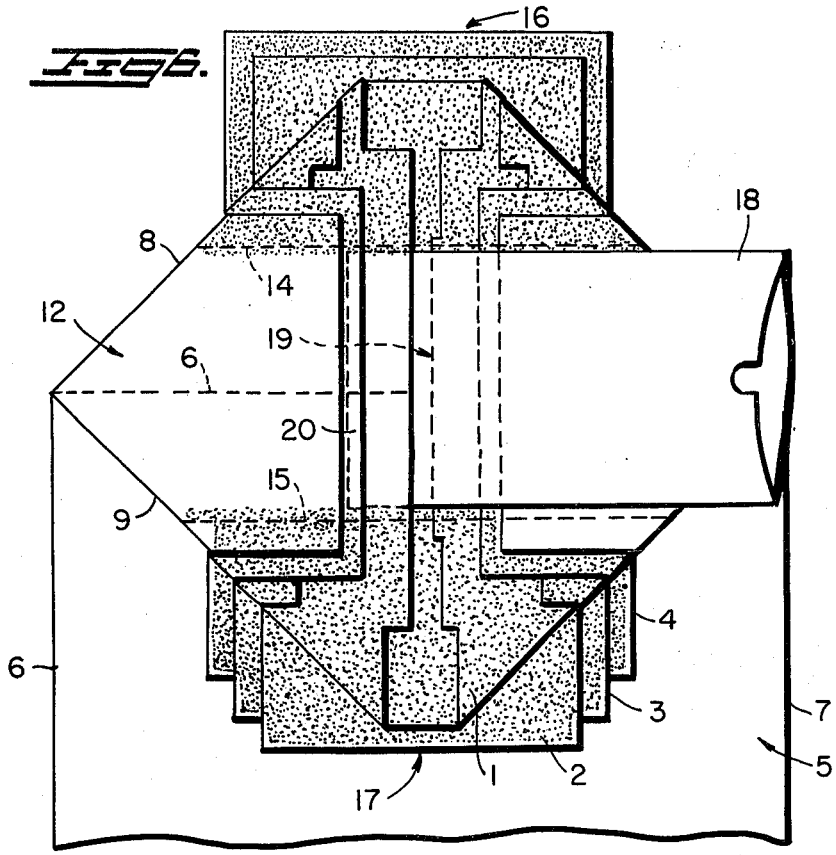
FIG. 6 is a partial plan view of the bag of FIG. 5 showing a valve sleeve in place.

FIG. 6 illustrates the manner in which a valve sleeve 18 is positioned in the bag. For this purpose a valve sleeve 18 in the form of a tube is arranged so that it extends across the gap 19, and its inside edge 20 is located underneath the infolded panel 12. The remainder of the sleeve 18 is positioned to lie over the infolded panel 13 with its outer edge 21 located near the edge 7 of bag 5. The valve sleeve is generally prepared from paper, paper having a heat sealable coating on the inner surface thereof or paper with a heat sealable material laminated to its inner surface. The top or valve end of the bag is closed substantially as with conventional PVSE bags. That is, a pattern of paste is applied to the overlapping flaps 16,17 and to the infolded panel 13. The valve sleeve 18 is adhered to the pasted surface of infolded panel 13 and the overlapping flaps are sealed together and to the infolded panel 12 and the upper surface of valve sleeve 18. This arrangement provides a positive closure that prevents product from sifting through the filling gap 19 and prevents product from getting out the scores at the corners of the bag where sifting normally occurs with conventional PVSE bags. Where the bag construction is modified so that the valve end of the bag is provided with overlapping infolded panels, there would be no filling gap into which a sleeve could be inserted. Nevertheless, the infolded panels could be separated to provide an open space therebetween for accepting a sleeve. Accordingly, the heretofore described construction provides a valve end closure that is virtually leak resistant.

The bottom of the bag of the present invention according to one embodiment is rendered substantially leak and sift resistant by arranging the step pattern so that one of the bag plies overlaps itself in the region between the infolded flaps where a gap is normally found in conventional PVSE bags. FIG. 5 illustrates a preferred arrangement of the bottom construction. In this instance, the bag tube 5 is provided with diagonal scores 28,29 and 30,31 at each corner to form the folds for the infolded panels on flaps 32,33. In addition, transverse scores 34,35 are provided in the tube 5 for the folds for the overlapping flaps 36,37. The side edges of overlapping flaps 36,37 are formed by slits in the tube. Subsequently, the infold panels 32,33 in the bottom of the bag are permitted to overlap by cutting and stepping the plies in the tube so that from the slits to the edge of the tube on each side, the number two ply extends beyond the flaps. Thus, when the infold panels 32,33 are folded inwardly, the number two ply extends from the edge of the tube beyond the center of the tube's width, providing an overlap of the number two ply in the bottom of the bag. Overlapping the number two ply prevents product from getting into the channels formed by the flap and edge scores at each side on the bottom of the bag. A solid bar of paste (not shown) may also be placed across the width of both infold panels 32,33 between the number one and number two plies to prevent product from getting between those plies in that region. The bottom of the bag is closed by applying paste to the inside of the overlapping flaps 36,37 as shown in FIG. 5. Subsequently, one of the overlapping flaps 36 or 37 is folded over and adhered to the infolded panels 32,33 and the remaining overlapping flap is adhered to the first overlapping flap. This arrangement provides a positive closure at the bottom of the tube 5 that prevents product from sifting into the channels formed by the scores at 34,35 and 6,7. Accordingly, the bag construction herein also provides a bottom or non-valve end closure that is virtually sift resistant.

Figure 2:
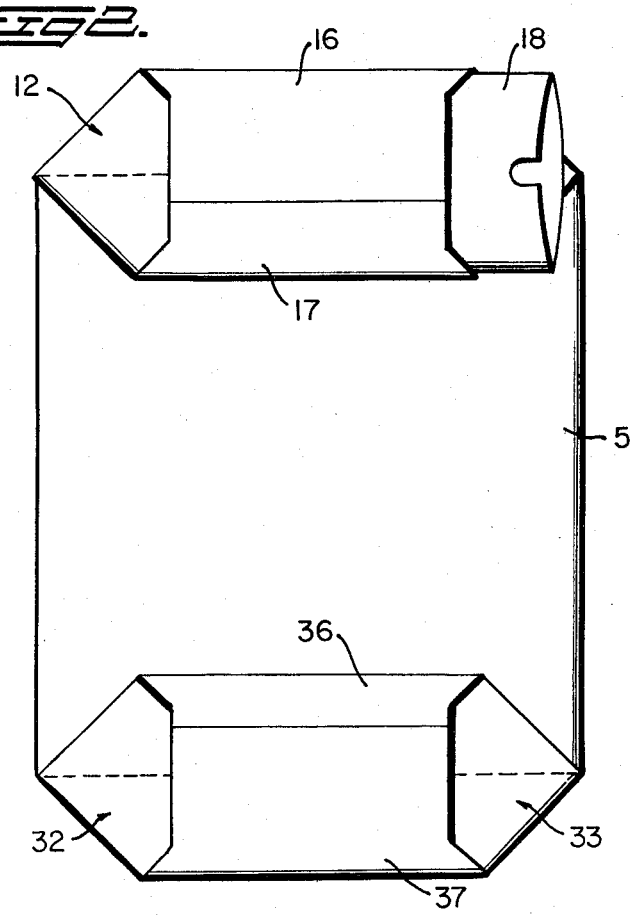
FIG. 2 is a plan view showing a finished bag with both ends sealed and ready for shipment to a user.
Figure 7:
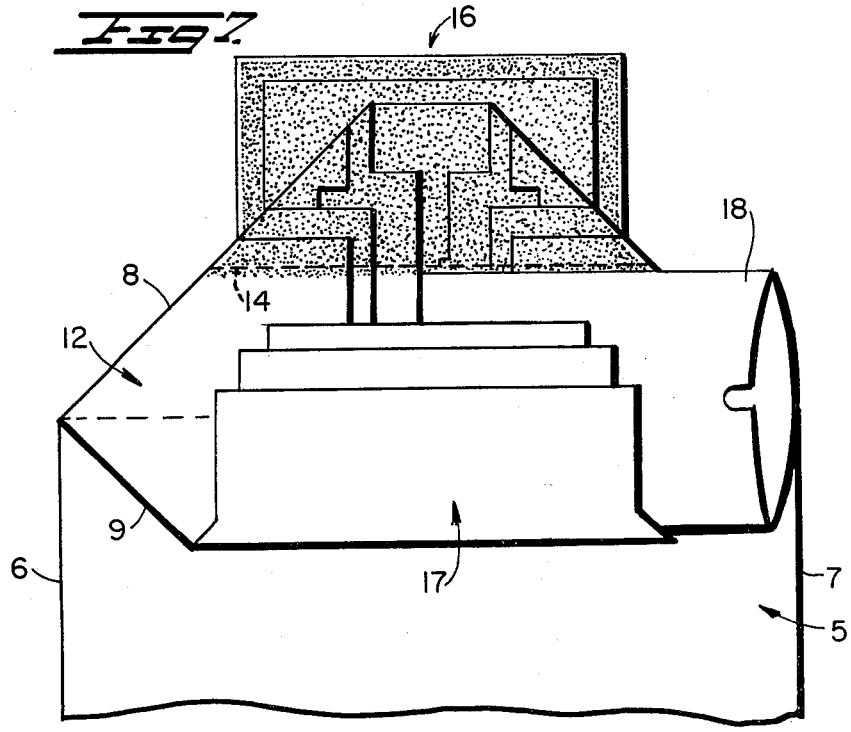
FIG. 7 is a view similar to FIG. 6 showing the first folding step for closing the top of the bag.

FIG. 7 illustrates the first folding step in forming the valve end of the bag where the infolded flaps are slightly spaced apart to provide a filling gap. After the valve sleeve 18 is positioned within the filling gap 19 and underneath the inner edge of infolded panel 12, the sleeve is adhered to a prepasted area on infolded panel 13. Subsequently, overlapping flap 17 is folded over about score line 15 and adhered to the top of sleeve 18 at one corner and to the upper surface of second infolded flap 12 at the opposite corner. Finally, the second overlapping flap 16 is folded over about score line 14 and adhered to the first flap 17. These steps produce a finished bag as shown in FIG. 2. The same appearance would be achieved with finished bags where the infolded flaps overlapped one another at the valve end.

FIG. 2 illustrates the sealed bag in its flattened condition for shipping to the proposed user. At the top of the tube 5, the overlapping flaps 16,17 are adhered together and to the infolded panel 12 and valve sleeve 18 as described hereinbefore. Meanwhile at the bottom, the overlapping flaps 36,37 are adhered to one another and to the infolded panels 32,33.

Figure 1:
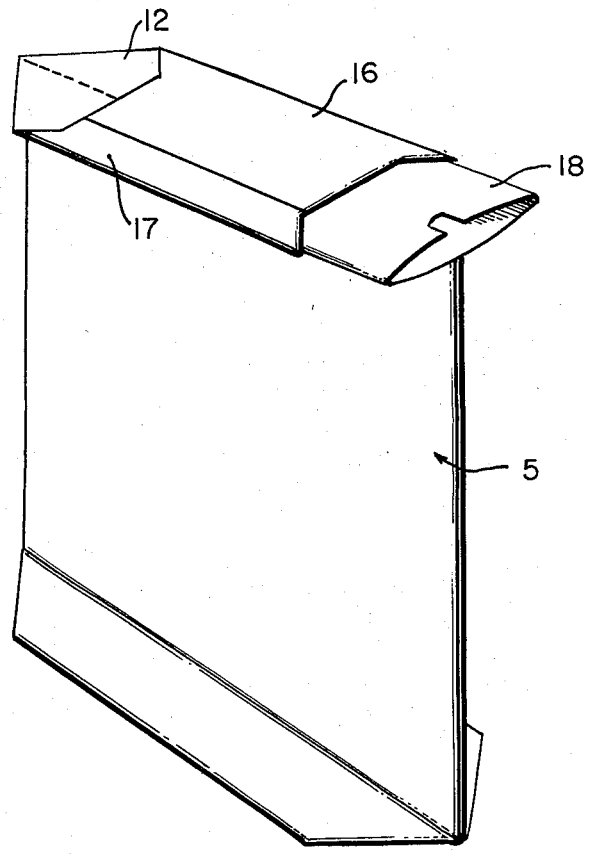
FIG. 1 is an isometric view showing a finished bag according to the present invention ready to be filled.

The bag is set up for filling substantially as shown in FIG. 1. At this time, a filling spout is inserted in valve sleeve 18 and the bag is filled with product to the specified capacity. After filling, the sleeve 18 can be closed off by folding over and tucking it under itself so that it does not extend beyond the edge of the filled bag. For very fine or powdery products, where a more positive closure of the sleeve is desired, the sleeve may be coated or lined with a heat sealable material so that the end of the sleeve extending outside the valve can be first heat sealed closed and then folded and tucked in.

Figure 8:
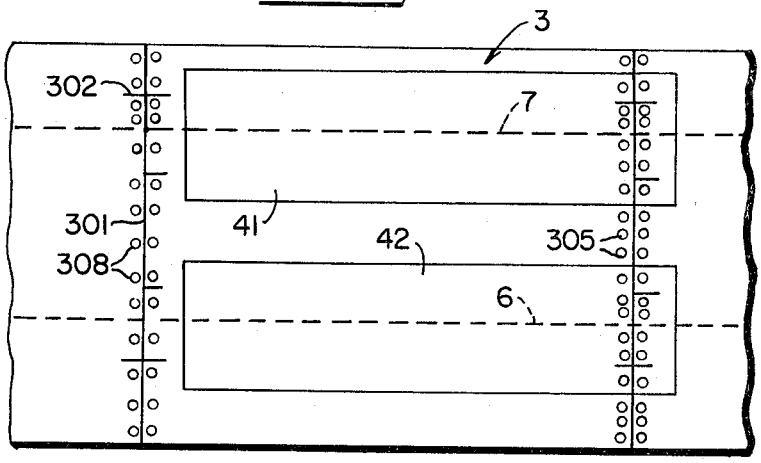
FIG. 8 is a plan view of another preformed bag ply showing the second embodiment reinforcing strips in place.
Figure 9:
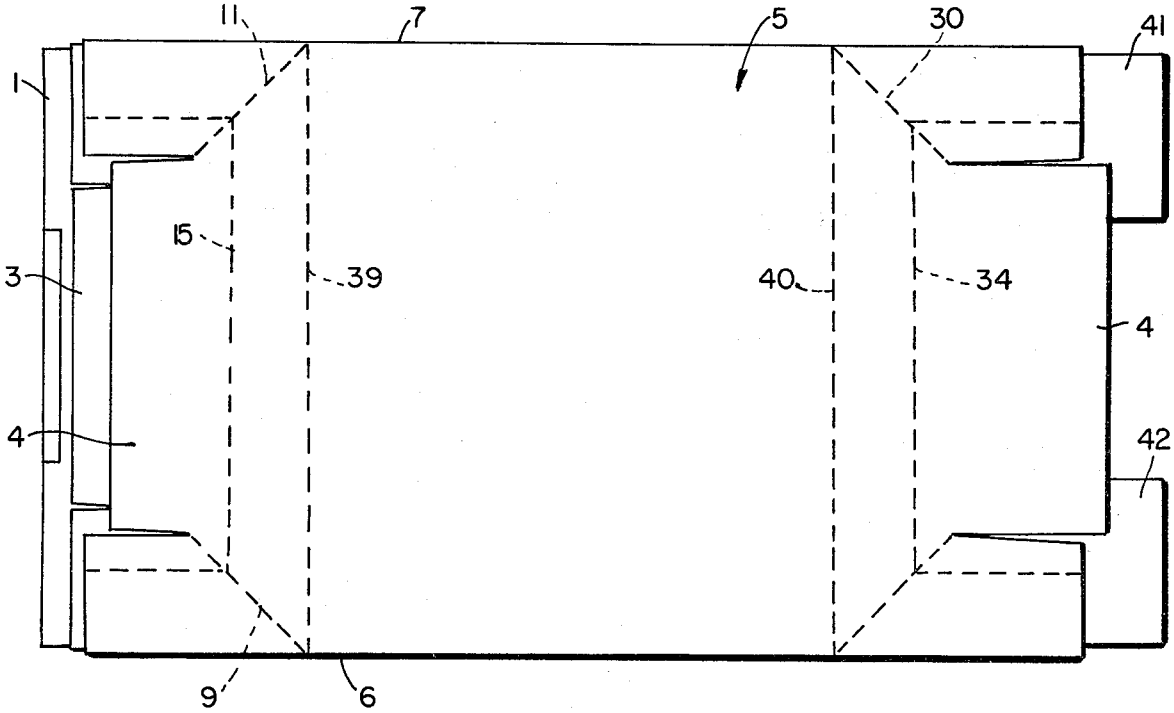
FIG. 9 is a plan view of a bag tube formed with reinforcing strips.
Figure 10:
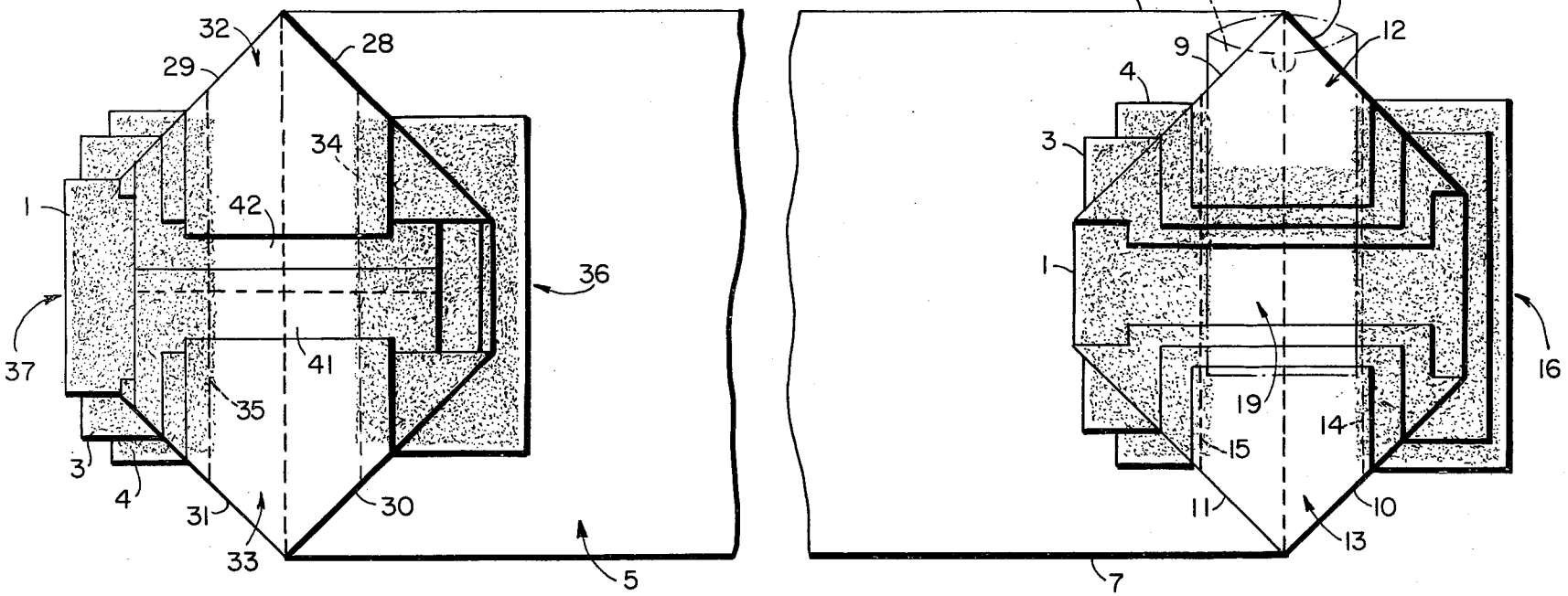
FIG. 10 shows the bag of FIG. 9 with the ends folded, a valve sleeve in place and adhesive applied.

FIGS. 8–10 illustrate another embodiment for carrying out the principles of the present invention. FIG. 8 shows in plan a typical number three bag ply with a pair of reinforcing strips 41,42 applied over the side score lines 6,7. The reinforcing strips 41,42 have the same nominal length as the bag ply shown, but they are positioned so as to extend beyond one end of the bag ply. This orientation produces a bag tube substantially as shown in FIG. 9 with only three bag plies. Note in FIG. 9 that the left or valve end of the bag shows the stepped ends of the numbers one, three and four plies. However, the right or bottom end of the bag shows the reinforcing strips 41,42 extending well beyond the nominal end of the bag tube. This arrangement permits the manufacture of a bag having a face width greater than would be permitted using the construction of the first embodiment for a given size valve. Because of the presence of the extended reinforcing strips 41,42, less tube material must be incorporated into the infolded panels to achieve an overlapped condition at the bottom of the bag. The less material used in the infolded panels means more material available for the face width or body of the bag. At the same time, the filling gap at the top of the bag is also increased in width, however the wider filling gap simply requires a valve sleeve having extra length.

FIG. 10 shows the bag made from the tube of FIG. 9 with the ends scored and squared for adhesive application and closing. Note that a valve sleeve 18 is shown in phantom lines in FIG. 10 which extends from the edge 6 of the bag tube across the enlarged filling gap 19, and beneath the opposite infolded panel 13. Meanwhile, at the bottom of the bag, the reinforcing strips 41,42 are overlapped at their inner edges to produce an effective seal at the bottom of the bag. When adhesive is applied to the closure flaps as shown in FIG. 10, and the outer overlapping flaps folded over and adhered in place, a substantially sift resistant bag as shown in FIGS. 1 and 2 is produced.

Although several embodiments of the invention are disclosed herein for purposes of explanation, various other modifications may be apparent to those skilled in the art. For instance, while the valve size dictates the face width of the bag according to the first embodiment, the length of the bags may be varied within the limits of the currently available bag making equipment. The preferred number of plies for making a bag according to the present invention is three or four plies for adequate strength and sift resistance. However, a light weight bag for products where sift resistance was not a major concern could be made with two plies. The amount of paper folded in at each end of the bag depends upon whether the infolded flaps are overlapped or not. In most cases, the infolded flaps will be overlapped at the bottom and slightly spaced from one another at the top to provide a filling opening. Nevertheless, as set forth hereinbefore, the infolded flaps may be sized so as to overlap one another at both ends where desired. Accordingly, reference should be made to the appended claims in order to determine the scope of the invention.

We claim:

1. A method for the manufacture of pasted valve, stepped end multiwall bags comprising the steps:

(a) assembling two or more webs of material for forming the bag walls;

(b) perforating said webs transversely in step patterns across their entire width to define bag lengths;

(c) superposing said webs one with respect to the other and gluing them together to form stepped end tubes having two ends, opposed sides and opposed corners at each end;

(d) separating said stepped end tubes from one another;

(e) scoring the ends of each tube to form opposed diamond shaped infolded panels at each corner and overlapping flaps along each side thereof;

(f) providing an extension for each infolded panel along at least one end of the tube;

(g) folding the opposed infolded panels at each corner of the tube so that the extensions along at least one end of the tube overlap one another; and, (h) folding and gluing the overlapping flaps at each side of the tube to provide a bag with a completely sealed bottom at the end of the tube where the infolded flap extensions overlap and a valve opening at the other end.

2. The method of claim 1 further comprising the step:

(i) positioning and gluing a valve sleeve at the other end of said tube within the valve opening so that one end of the sleeve extends over the infolded panel at one corner of the tube and underneath the infolded panel at the other corner of said tube.

3. The method of claim 2 wherein the infolded panel extensions are provided by portions of one or more of the webs which form the bag walls.

4. The method of claim 2 wherein the infolded panel extensions are provided by adding reinforcing panels between the walls of the bag at each corner thereof.

5. The method of claims 3 or 4 wherein the opposed infolded panels at the valve end of said tube are folded so the inner edges thereof lie adjacent to one another but slightly spaced apart to provide a filling gap of minimum width.

6. A sift resistant, pasted valve, stepped end bag prepared from a tube having multiple side walls comprising a valve end, bottom end, opposed sides and opposed corners at each end, said ends being scored with diagonal and transverse scores to provide opposed diamond shaped infolded panels at each corner and overlapping outer flaps at each side thereof, said infolded panels being provided with extensions along at least one end of the tube and being folded so that the extensions along at least one end of the tube overlap one another, and said overlapping flaps being folded and glued at each end to provide a bag with a completely sealed bottom at the end of the tube when the infolded flap extensions overlap and a valve opening at the other end.

7. The bag of claim 6 wherein a valve sleeve is positioned and glued within the valve opening at the other end of said tube so that one end of the valve sleeve extends over the infolded panel at one corner of the tube and underneath the infolded panel at the other corner of said tube.

8. The bag of claim 7 wherein the infolded panel extensions are formed by portions of one or more of the side walls used to form the bag.

9. The bag of claim 7 wherein the infolded panel extensions are formed by adding reinforcing strips between the side walls used to form the bag.

10. The bag of claims 8 or 9 wherein the opposed infolded panels at the valve end of said tube are folded so the inner edges thereof lie adjacent to one another but slightly spaced apart to provide a filling gap of minimum width.

11. A sift resistant, pasted valve, stepped end bag prepared from a tube having multiple side walls comprising a valve end, bottom end, opposed sides and opposed corners at each end, said corners being scored with diagonal and transverse scores to provide opposed diamond shaped infolded panels at each corner and overlapping outer flaps at each side thereof, said infolded panels along the bottom end of the tube being provided with extensions which are folded so the inner edges thereof overlap one another when the tube is formed into a bag and said infolded panels at the valve end being sized and folded so that the inner edges thereof lie adjacent to one another but slightly spaced apart when the tube is formed into a bag to provide a filling gap of minimum width, said overlapping flaps at each end being folded and glued to provide a bag with a completely sealed bottom end and a valve opening at the valve end.

12. The bag of claim 11 wherein a valve sleeve is positioned and glued within the valve opening at the valve end of said tube so as to extend across the filling gap and underneath the infolded panel at one corner of the tube and over the infolded panel at the opposite corner of said tube.

13. The bag of claim 12 wherein the infolded panel extensions at the bottom end of the tube overlap one another by at least about one-half inch.

14. The bag of claim 13 wherein the folded panels at the valve end of said tube are spaced from one another to provide a filling gap of at least about one-half inch.

15. The bag of claim 14 wherein the infolded panel extensions are formed by portions of one or more of the side walls used to form the bag.

16. The bag of claim 14 wherein the infolded panel extensions are formed by reinforcing strips which are incorporated between the side walls used to form the bag.

* * * * *